US005435011A

United States Patent [19]

Nicolai et al.

[11] Patent Number: 5,435,011

[45] Date of Patent: Jul. 25, 1995

[54] NECKTIE WITH POCKET

[76] Inventors: John H. Nicolai, 17340 Blueridge Turnpike; Michael A. Strong, P.O. Box 144; Jo Ann H. Belew, 17340 Blueridge Turnpike, all of Gordensville, Va. 22942

[21] Appl. No.: 113,440

[22] Filed: Aug. 27, 1993

[51] Int. Cl.[6] ..... A41D 25/16; A41D 27/20

[52] U.S. Cl. ..... 2/145; 2/144; 2/146; 2/247

[58] Field of Search ..... 2/144, 145, 146, 147, 2/148, 149, 150, 151, 152.1, 153, 154, 155, 156, 157, 247, 248, 249, 250, 251, 252, 253, 254

[56] References Cited

U.S. PATENT DOCUMENTS

| | | | |
|---|---|---|---|
| 517,769 | 4/1894 | Selowsky | 2/144 |
| 1,550,134 | 8/1925 | Whitney | 2/144 |
| 1,593,299 | 7/1926 | Goldberg | 2/146 |
| 3,206,765 | 9/1965 | Sherman | 2/144 |
| 3,744,058 | 7/1973 | Bond | 2/157 |
| 3,842,436 | 10/1974 | Hirschson | 2/157 |

FOREIGN PATENT DOCUMENTS

| | | | |
|---|---|---|---|
| 1218237 | 5/1960 | France | 2/144 |
| 1278738 | 11/1961 | France | 2/146 |
| 2646995 | 11/1990 | France | 2/144 |
| 226911 | 5/1943 | Switzerland | 2/144 |

OTHER PUBLICATIONS

Gershman, Maurice, "Self Adhering Nylon Tapes". The J. A.M. A, vol. 168, No. 7, Oct. 18, 1958, p. 930.

*Primary Examiner*—Jeanette E. Chapman
*Attorney, Agent, or Firm*—Sheldon H. Parker

[57] ABSTRACT

A necktie having a pocket features a strip having a first end, a second end, and a length between the ends. The strip is formed of a flattened tubular fabric material, creating an ornamented side and a body side with a cavity between the two sides. Each side of the strip has a first and a second surface. The second surface of the ornamental side lies adjacent to the first surface of the body side. The pocket is attached to the second surface of the ornamental side, fitting within and extending to the edges of the strip. The opening of the pocket is generally accessible to a wearer of the necktie.

10 Claims, 5 Drawing Sheets

NECKTIE WITH POCKET

BACKGROUND OF THE INVENTION

1. Field of the Invention

The present invention relates to apparel, and in particular, neckties having a container or pocket for storing objects such as money or condoms.

2. Description of the Prior Art

With the advent of AIDS, the concern with the danger of sexually transmitted diseases has increased dramatically. The need to be prepared for sexual activity mandates that a condom be carried on one's person, in readiness for sexual activity. Carrying a condom in one's wallet has the problem that the condom has a tendency to create a telltale circle in the surface of the wallet. Current attitudes are such that the circle tends to be the subject of humor and embarrassment, thus discouraging the practice of being prepared at all times. Moreover, carrying a condom in a wallet subjects the condom package to abuse and can, at the very least, ruin the appearance of the condom package and damage the condom making it unsafe to use. There is a realistic fear that the damaged package indicates that the condom has been ruined.. Most importantly, heat from the body can degrade the condom making unsafe to use.

The prior art is replete with ties having containers or packages for various objects. U.S. Pat. No. 5,073,987, entitled "Tie With Picture Pocket" and issued to Crosier on Dec. 24, 1991, discloses a tie of the four-in-hand variety which features a pocket allowing a photograph to be positioned within the tie and displayed for others to see while it is worn. Because these ties tend to be bulky, they fail to lie as neatly as normal ties, and therefore suffer from substantial aesthetic and functional drawbacks.

Other references in the prior art disclose tie designs having pockets that remain visible while the tie is worn. For instance, Selowsky U.S. Pat. No. 517,769, entitled "Necktie" and issued on Apr. 3, 1894, discloses a tie having a flapped pocket positioned on the ornamental side of the tie. The pocket flap material of this design must match or blend with the ornamental side of the tie in order to preserve its aesthetic appeal. Moreover, in the case of patterned or striped ties, which constitute the majority of the styles worn today, maintaining alignment between the pocket flap material and the principal material of the ornamental side would be critical during the various steps of the construction process. The added attention required to ensure this result would likely increase production costs.

Another disadvantage of this design is shared by the design disclosed in the 5,073,987 patent discussed above: neither design permits a person wearing a necktie to carry a condom discretely. The design in the 5,073,987 patent features a clear window which would openly display the identity of any object carried in the pocket. Although the flapped pocket of the 517,769 patent design would hide the ties contents, its prominent presence on the ornamental side of the tie might prompt questions from the tie wearer's associates about the contents of the pocket.

The present invention overcomes the disadvantages of the prior art by providing a tie having a pocket which permits carrying a condom or other object securely and discretely, yet remains aesthetically pleasing. The present invention provides an easier way to manufacture a pocket for a tie, and therefore provide a less expensive manufacturing process than available the tie designs heretofore available.

BRIEF DESCRIPTION OF THE DRAWINGS

The advantages of the instant disclosure will become more apparent when read in conjunction with the specification and the drawings, wherein.

SUMMARY OF THE INVENTION

Figure 2:
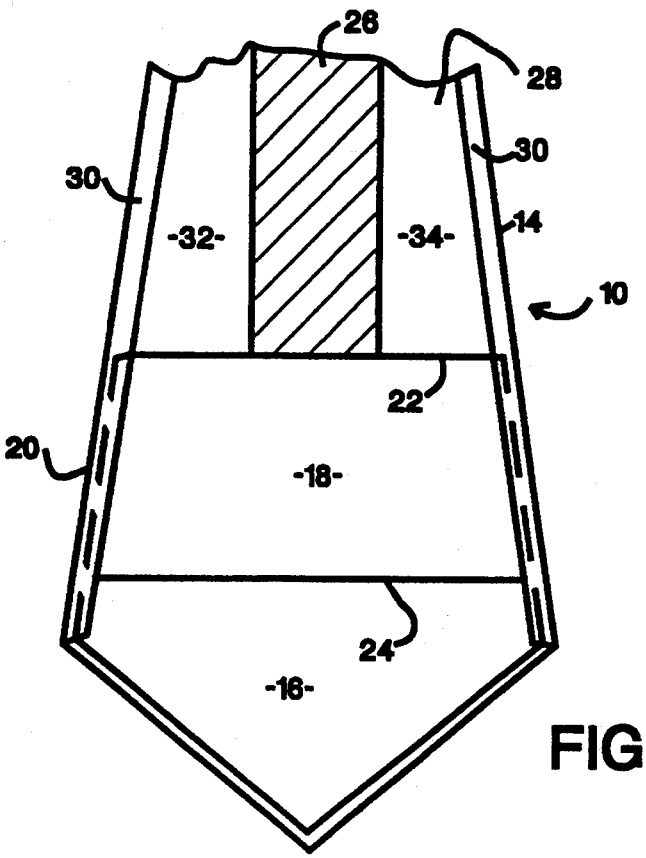
FIG. 2 is a fragmentary view of the tie of FIG. 1, with the various layers inverted and the stitching hidden.

It has now been found that a tie having a pocket can be provided without adversely affecting the appearance or use of the tie. The pocket does not interfere with the tying of the tie. A necktie having a pocket features an elongated strip which is formed of a flattened tubular fabric material. The elongated tubular fabric strip has an ornamental side and a body side. The tubular configuratin produces a cavity between the two sides. Each side of the strip has a first and a second surface. The second surface of the ornamental side lies adjacent to the first surface of the body side. The pocket is attached to the second surface of the ornamental side, fitting within and extending to the edges of the strip. In essence, the pocket can be formed from a lining material such that the tie has a conventional first ling and a second, pocket forming lining material. The opening of the pocket is generally accessible to a wearer of the necktie. The accessiblity results from the body side folds of the tie providing ready access to the pocket.

Preferably, the pocket remains concealed by the body side of the strip while the tie is being donned and worn. The pocket will accommodate at least one object, such as a coin, paper money, or a condom. The pocket opening can be securely closed by a fastener, such as a button and button loop or a hook and wool closure, of. The pocket opening can be configured in various ways. The pocket opening can be a vertical or horizontal slit across the back of the tie; the opening itself can be straight, V-shaped, or rounded. The edge of the opening can be rolled as it typical for pocket handkerchiefs or provided with a finished appeared by being a folded edge.

In practice, the flattened tubular fabric will usually have a decorative outer layer and at least one supporting inner layer. For reference, the decorative outer layer is the same as the first surface of the ornamental side and the second surface of the body side; the supporting inner layer is the same as the second surface of the ornamental side and the first surface of the body side.

With respect to the construction of the tie, the edges of the flattened tubular fabric can be joined by a fastener, such as a single stitch or an entire seam.

One of the ends of the strip can be wider than the other; the pocket can be positioned within the periphery of either end, or elsewhere along the strip between either end and the fastening means. Depending upon the construction of the tie, a patch pocket can be attached anywhere along the body side of the tie.

DETAILED DESCRIPTION OF THE INVENTION

One method of manufacturing a tie is disclosed in U.S. Pat. No. 4,694,509, the disclosure of which is incorporated by reference as though recited in full. Note that this prior method describes a process for manufacturing ties that feature a double fabric lining, although the principles decribed apply in the case of conventional single lined ties. Briefly, the method of making a lined tie for use with the instant invention broadly includes the following steps:

1. The necktie decorative material is cut to a predetermined shape and dimensions (a full or partial lining can also be cut to the same shape and dimensions as the outer material);
2. The decorative material and lining are superimposed one onto the other with the finished surfaces facing one another (an interfacing cut to the length and width of the width of the folded tie can be added for additional support);
3. The edges of the decorative material and lining are stitched together and the tie is turned "right side out";
4. The edges are folded to provide a smooth, finished edge along at least a partial periphery of the tie;
5. The tie is folded lengthwise into approximately one-third sections, and, if desired, can be blind stitched, thereby preventing the edges from opening.

Figure 1:
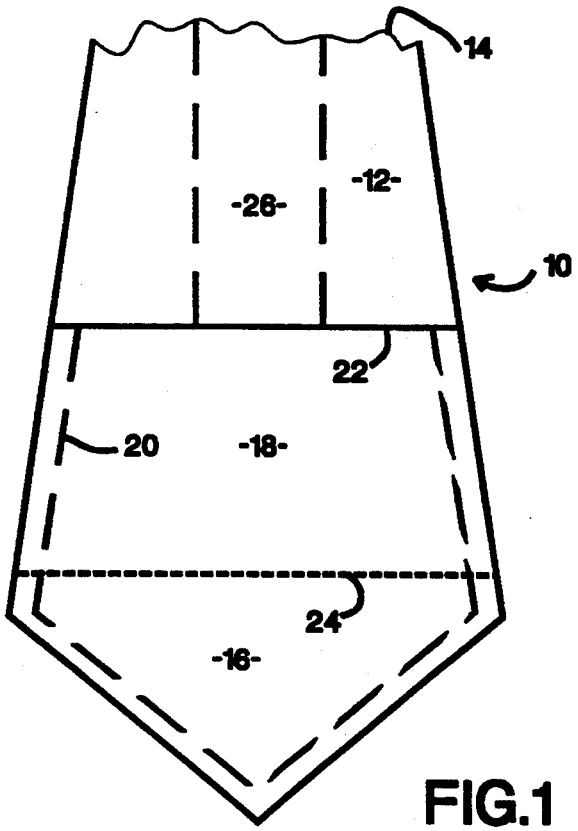
FIG. 1 is a fragmentary view of the tie of the instant invention, showing the various fabric layers as initially sewn together.

FIG. 1 illustrates the tie, indicated generally as 10, in the initial stages of manufacture, before being turned "right side out." The finished side 12 of the decorative fabric 14 is layered with first the pocket 16 and then the lining 18. The pocket 16 and the lining 18 are cut to correspond to the width and configuration of the tie 10. The height of the pocket 16 and length of the lining 18 will vary according to manufacturing requirements. The lining 18 can, alternatively, extend the entire length of the tie 10 to produce a heavier tie, dependent upon the type of decorative fabric 14 being used. The primary function of the lining 18 is to provide a finished appearance and cover the unfinished side 12 of the decorative fabric 14. It is therefore recommended that the lining 18 extend a significant distance beyond any sewn connections. The pocket 16 has a height less than that of the lining 18; its height criteria being that it is sufficient to serve as a holder for the desired object, in this case a condom. The lining 18 is stitched to the decorative fabric 14, at stitch lines 20, along the periphery of the tie 10. The pocket 16, being positioned between the decorative fabric 14 and the lining 18, is simultaneously stitched, thereby securing the pocket 16.

Note that because the pocket 16 is added at this early stage in the manufacturing process, the assembly operation remains essentially unchanged from the conventional tie manufacturing process. Except for the addition of the pocket 16, which is essentially similar to adding a second, short lining, the same steps are followed. All of these steps are well known in the art. In order to assemble the second lining to perform as a pocket, the second lining must be shorter in length than the conventional lining to allow the wearer to access the contents of the pocket 16. The second lining must also lie between the decorative fabric 14 and the lining 18 before the entire assembly is inverted in order to position the pocket 16 on the outide of the tie 10.

The lining open edge 22 and the pocket open edge 24 can be left as raw edges or, alternatively turned under and stitched prior to assembly. In the event that the lining open edge 22 and the pocket open edge 24 are turned under, both edges 22 and 24 must be flat to avoid any bulky lines in the finished tie 10. It is recommended that a lightweight, pliable fabric be used for both the pocket 16 and the lining 18 to avoid any unwanted bulk. Interfacing 26 can be used to provide the tie 10 with additional body. Generally, the decorative fabric 14 is manufactured from a soft, supple material, such as silk and the addition of interfacing 26 prevents the decorative fabric 14 from having a limp appearance. The interfacing 26 is placed on the unfinished side 28 of the decorative fabric 14, as shown in FIG. 2, and can be optionally secured to the decorative fabric 14 along stitch lines 20. The placement of the interfacing 26 divides the tie 10 into three approximately equal and parallel folds. For ease of reference herein, the first third will be referred to as first parallel fold 32, the second third as interfacing 26, and the third portion as parallel fold 34.

In FIG. 2, the tie 10 has been turned "right side out", forming a seam along stitch lines 20, thereby hiding the raw edges. The seamed edges create a folded portion 30 of finished side 12 along the periphery of the length of the tie 10. The folded portion 30 provides an optional finished edge to the completed tie 10, as described further herein. The access to the pocket 16 is clearly seen in FIG. 2 wherein pocket open edge 24 allows the desired object to be placed within the pocket 16. It should be noted that the pocket open edge 24 can be angled, curved or configured in any other manner that is aesthetically desired. The interfacing 26 is positioned at the center of the decorative fabric 14, as previously stated, and is preferably the width of the folded tie 10. As heretofore stated, the interfacing 26 can be stitched to the decorative fabric 14 along stitch line 20 or, alternatively, stitched when the tie 10 is folded, as described further herein.

Figure 3:
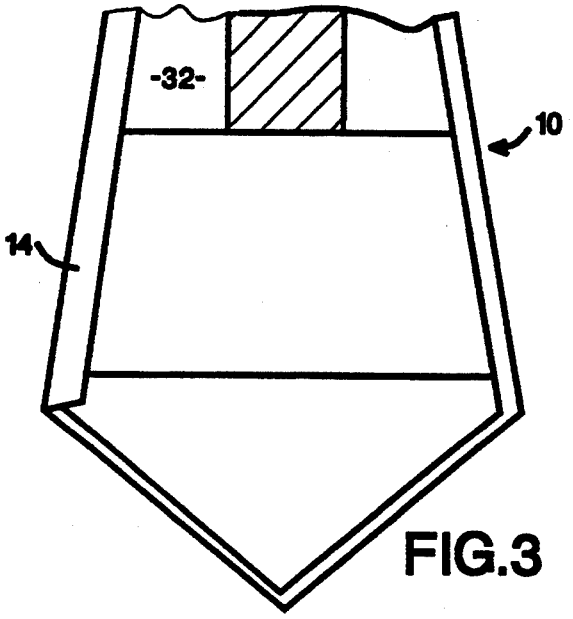
FIG. 3 shows the folding of one edge of the instant tie after the inverting step.

In FIG. 3, assembly of the tie 10 has progressed to the step prior to final folding. The lengthwise edge of the first parallel fold 32 is folded over, thereby positioning a narrow length of unfinished side 12 adjacent to unfinished side 12.

Figure 4:
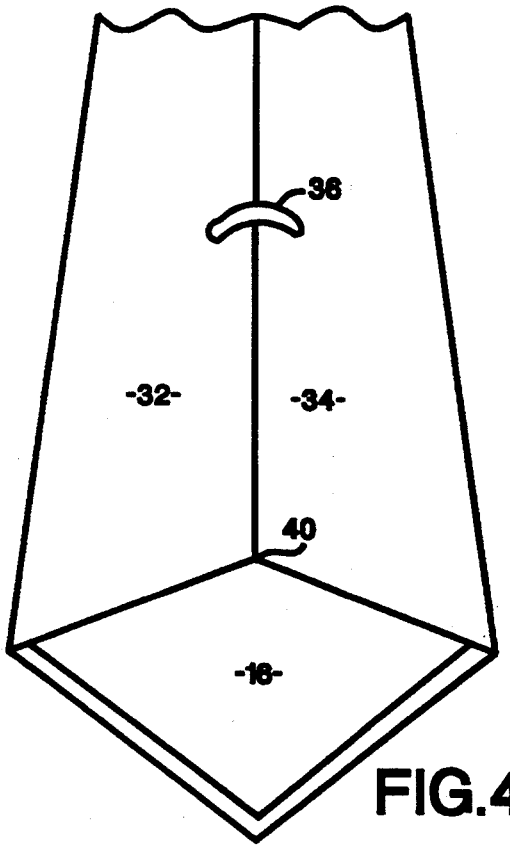
FIG. 4 shows the finished tie as normally used.

The finished tie 10 is illustrated in FIG. 4 in a ready-to-use state. The parallel folds 32 and 34 have been folded over to cover the interfacing 26, with the parallel fold 32 overlapping the parallel fold 34. The parallel folds 32 and 34 can be secured with a stitching loop 36, or alternatively, they can be stitched along the entire length of the tie 10. The stitched region of the parallel folds 32 and 34 prevents the parallel folds 32 and 34 from spreading apart and exposing the unlined, unfinished side 12 of the tie 10.

Figure 5:
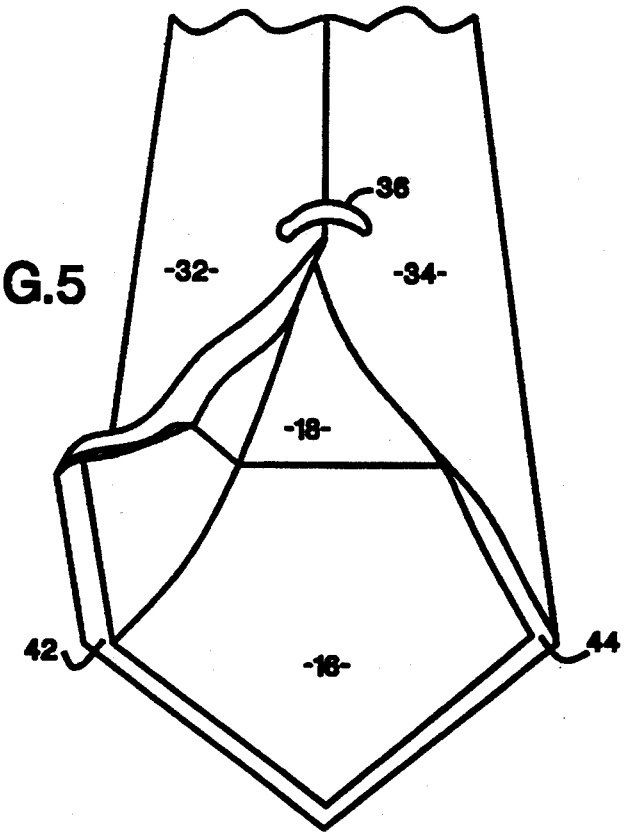
FIG. 5 shows the finished tie with all folds completed, and showing one flap moved aside to expose the pocket.

In FIG. 5, the tie 10 is illustrated with a portion of the unstitched area of the first parallel fold 32 folded back, thereby allowing access to the pocket 16 at pocket open edge 24. The condom can be slid in or out of the pocket 16 at the pocket open edge 24 without any disassembly of the tie 10. The normal resistance of both the first parallel fold 32 and parallel fold 34 to opening prevents exposure of the pocket 16 and protects the contents of the pocket 16 from being lost. The pocket 16 must be sufficiently below the stitching loop 36 or sewn region so as to provide ease of access to the pocket open edge 24. As evident from FIG. 5, the lining material which forms the pocket 16 has its open or upper edge 24, substantially below the upper edge of the ling 18. Thus, while the lining serves its normal functions, the pocket is of lesser longitudinal extent and has its upper edge accessible by merely folding back either or both of the fold sectins 32 or 34. Advantageously, the upper edge 24 of the pcoket 16 is slightly above the interection point 40, as illustrated in FIG. 4, of the folds 32 and 34. This configuration provides for the concealing of the pocket and the effective covering of the pocket. Thus, even if the pocket is not provided with a positive closure mechanism, the contents of the pocket have a reduced probablity of being lost since the folds 32 and 34 overlie the pocket. It is thus preferred that the pocket open edge 24 be proximate the intersection point 40. To the extent that the edge 24 is below the intersection point, the pocket is visible. As long as the open edge 24 is above the lower outer edges 42 and 44 respectively of folds 32 and 34, the contents of the pocket is protected against loss. Optimum protection is acheived when the oopen edge 24 is above the intersection point 40. Thus, the novel double lining of the instant invention provides a pocket which can be entirely or partially hidden from view even when the backside of the tie is visible and which protects the contents of the pocket from loss even if the pocket is not provided with a positive closure such as a hook and eye, button and button hole or button loop, hook and fabric fastener, and the like.

Figure 6:
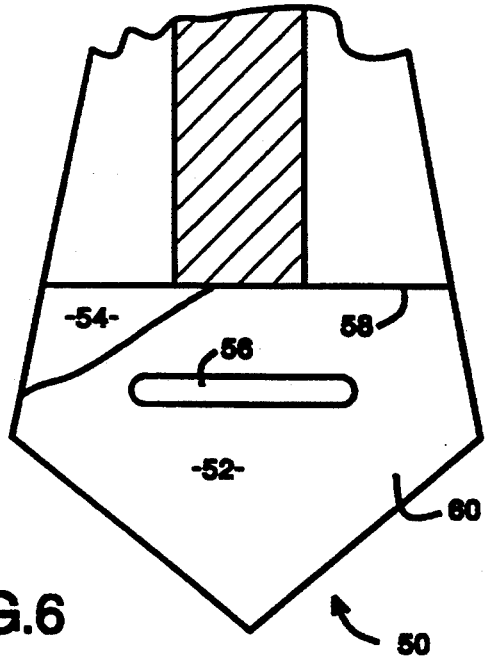
FIG. 6 illustrates an alternate embodiment of the instant invention.

An alternative to the foregoing tie 10 is illustrated in FIG. 6 wherein the pocket forming layer 52 is on the order of the size of the primary liner 54. In such case, the pocket forming layer 52 is slit at opening 56 to provide access to the pocket formed by the pocket forming layer 52 and the primary liner 54. The opening 56 must be positioned below the stitched portion, as described heretofore, to allow easy access. The pocket forming layer 52 and the primary liner 54 can be stitched together along top edge 58 prior to stitching, as heretofore described.

Figure 7:
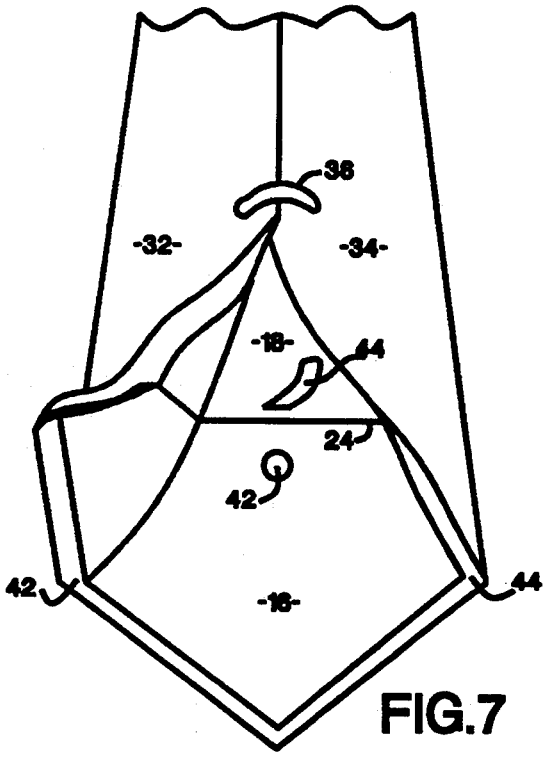
FIG. 7 illustrates the tie of the instant disclosure with a loop and wool fastener.

Various means exist for more positively closing the pocket opening. Additional closure protection can be achieved by providing a closure locking mechanism such as a hook and wool closure, an example of which is sold under the trademark Velcro, and illustrated in FIG. 7. The hook portion 44 is affixed to the lining 18 and the wool portion 42 is affixed to the pocket 16. The hook portion 44 and wool portion 42 are affixed to the fabric by stitching or adhesive, as is well known in the prior art. Alternatively, the hook portion 44 can be affixed to the first parallel fold 32 of the tie 10. In the event that the hook portion 44 is affixed to the parallel fold 32, wool portion 42 can need to be slightly off center in order to line up with the hook portion 44 without causing the tie 10 to be askew.

Figure 8:
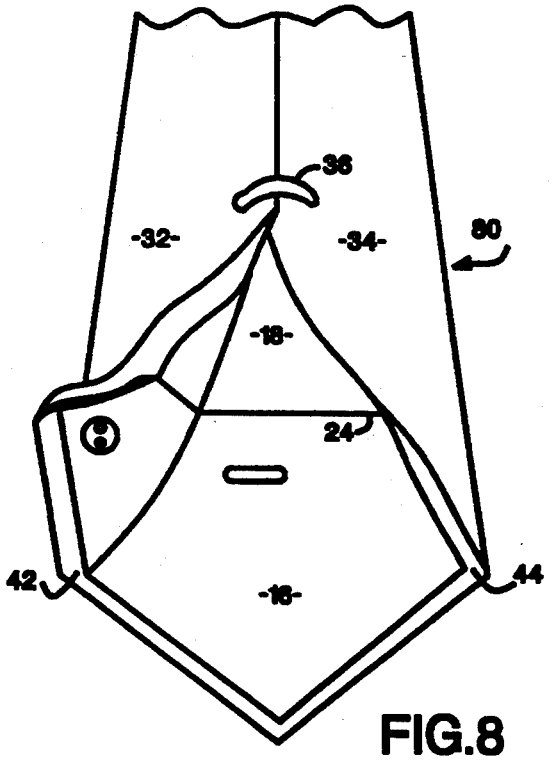
FIG. 8 illustrates the tie of the instant disclosure with a button and hole fastener.

In another embodiment, shown in FIG. 8, the pocket 16 can be secured to the first parallel fold 32 by means of a button 48 and button hole 46. As previously stated with the hook and wool closures, the button 48 and button hole 46 must be aligned to avoid any ripples in the tie 80. One advantage of applying the closure mechanism to the decorative fabric 14 is that the decorative fabric 14 is typically heavier and more durable than the fabric of the lining 18. Therefore, the button 48 and button hole 46 closure, as well as the hook 44 and wool 42 closure, have less influence on the feel of the tie 10 and will result in a longer lasting tie under repeated use.

Figure 9:
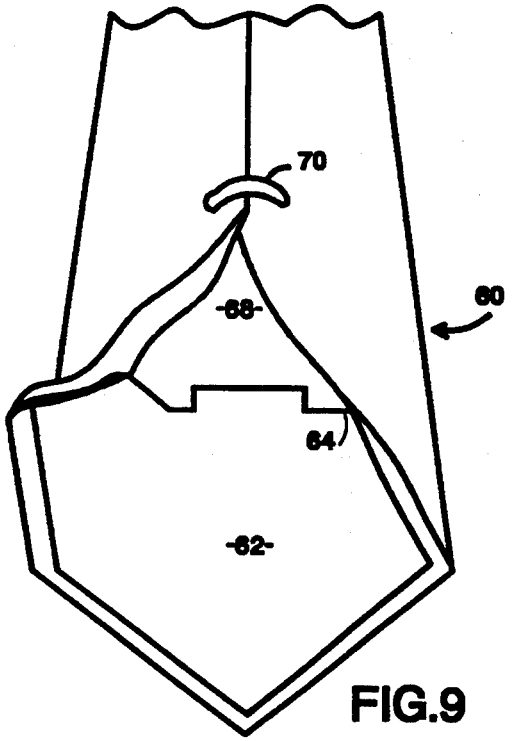
FIG. 9 illustrates an alternate closure flap for the instant invention.

In FIG. 9 pocket forming liner 62 is provided with a flap region 66 which extends up toward the stitched loop 70. The flap region 66 is affixed to the liner 68 by any of the means previously discuss herein or known in the prior art.

Figure 10:
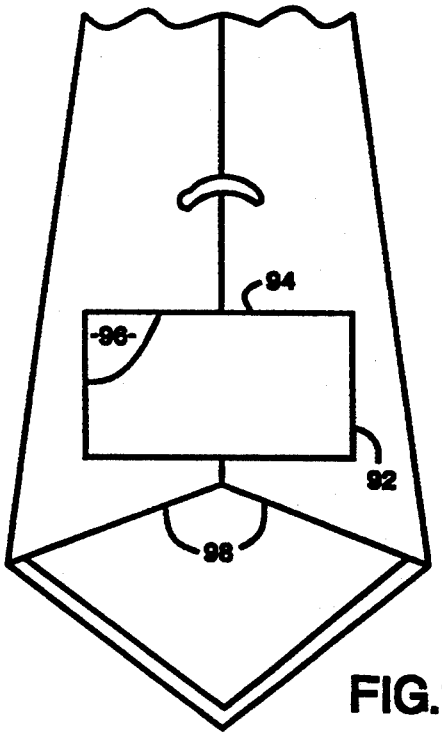
FIG. 10 illustrates an additional embodiment to the instant invention.

An alternative to the hidden pocket described heretofore is the add-on pocket 92 of FIG. 10. The pocket 92 is stitched along three sides to the tie folds 98. The open edge 94 is left unstitched for insertion of the condom or other article. The pocket 92 can, alternatively, be provided with a lining 96 which is stitched to the tie folds 98 along all four edges. The lining 96 prevents the condom or other article from becoming wedged in the tie folds 98. The add on pocket must have sufficient width to accomodate an object such as a condum, and thus preferably is substantially as wide as the section of the tie on which it is mounted. It should be understood that the pocket must sufficiently inward of the outer edges to avoid being visible when the tie is in use. The pocket should be proximate the lower tie fold edges 98, so that maximum pocket width can be provided without being so close to the outer edges of the tie to be visible when the tie is view from the from. The add-on pocket 92 can be provided with a closure, e.g., the button/button hole or hook/wool types.

The ties herein can be either square-ended or triangle-ended. Although the examples discussed above relate to lined ties, the principles of the invention apply to woven or knit ties, as well as other neckwear.

Since other modifications and changes varied to fit particular operating requirements and environments will be apparent to those skilled in the art, the invention is not considered to be limited to the examples chosen for the purposes of disclosure, and therefore covers all changes and modifications which do not constitute departures from its true spirit and scope.

GLOSSARY

10 tie
12 finished side
14 decorative fabric
16 pocket
18 lining
20 stitch lines
22 lining open edge
24 pocket open edge
26 interfacing
28 unfinished side
30 folded portion
32 first parallel fold
34 parallel fold
36 stitching loop
40 intersection point
42 lower, outer edge of fold 32
44 lower, outer edge of fold 34
52 pocket forming layer
54 primary liner
56 opening
60 top edge
62 pocket forming liner
68 liner 92 add-on pocket
94 open edge 94
96 lining
98 tie folds

What is claimed is:

1. A three layer necktie having a pocket region, comprising:

a) a decorative layer, said decorative layer being a fabric strip having an ornamented side, a body side, a first end, a second end, and a length, said length having a first length edge and a second length edge, b) a liner layer, said liner layer being a fabric strip positioned proximate said first end of said decorative layer and being coextensive with the width of said decorative layer and a substantial portion of said length, said liner being peripherally attached to said body side of said decorative layer, c) a pocket layer, said pocket layer being attached to said liner and forming a pocket having a length substantially less than the length of said liner, said pocket layer being affixed to said liner along a portion of the periphery of said pocket layer to provide an opening, said opening being generally transverse to said length of said decorative layer, wherein said decorative layer and said liner layer are folded along the first length edge and the second length edge, folding the liner layer onto itself, whereby said ornamental encompasses a substantial portion of said liner.

2. The necktie having a pocket as described in claim 1, wherein adjacent edges of said first length edge and said second length edge are secured together at, at least one point, said at least one point being a sufficient distance from said pocket opening to allow for access to said pocket.

3. The necktie having a pocket as described in claim 1 wherein said pocket is of sufficient size to accommodate at least one object.

4. The necktie having a pocket as described in claim 3 wherein said object is at least one condom.

5. The necktie having a pocket as described in claim 1 further comprising a fastening means for closing said opening of said pocket.

6. The necktie having a pocket as described in claim 5 wherein the fastening means comprises a hook and wool closure.

7. The necktie having a pocket as described in claim 5 wherein the fastening means comprises a button and a means for receiving said button.

8. The necktie having a pocket as described in claim 1 wherein said pocket layer is pentagonal in shape, and said opening being substantially transverse to the length of said strip and is opposite a triangular corner region of said pocket layer.

9. The necktie having a pocket as described in claim 8 wherein said first end has a greater width than said second end.

10. A method for assembling a tie having a pocket, comprising the steps of:

a) cutting an elongated decorative fabric strip to a desired shape, said decorative fabric strip having an exterior side, an interior side, two ends, a length there between, and two elongated edges;

b) cutting a lining layer to a designed length and to substantially said desired shape of at least a portion of said decorative fabric strip;

c) cutting a pocket layer to substantially the shape of one end of said decorative fabric strip and to a length less than said length of said decorative fabric strip and said liner layer;

d) aligning said pocket layer between, and within the periphery of, said exterior side of said decorative fabric strip and said lining, forming a tie assembly;

e) securing the components of said tie assembly to one another along all but a portion of one peripheral edge of said decorative fabric strip, creating a peripheral opening;

f) inverting said tie assembly by bringing said secured components of said tie assembly through said peripheral opening until the desire shaped is obtained;

g) folding said two elongated edges of said decorative fabric strip over toward one another and forming a tubular assembly, said tubular assembly at least partially overlying said pocket layer; and h) securing said two edges together, at at least one securing point proximate said one end of said decorative fabric strip, and a distance defined from said one end of said decorative strip to the open end of said pocket, said distance being less than a distance from said one end to said at least one securing point;

whereby said pocket is accessible to the user of the tie while it is being worn.

* * * * *